US010334949B2

(12) United States Patent
Leinonen et al.

(10) Patent No.: US 10,334,949 B2
(45) Date of Patent: Jul. 2, 2019

(54) SYSTEM FOR FIXATION OF SHELF ACCESSORIES TO A SHELF

(71) Applicant: HL DISPLAY AB, Nacka Strand (SE)

(72) Inventors: Asko Leinonen, Borlänge (SE); Isak Åberg, Stockholm (SE); Mårten Sjöberg, Stockholm (SE)

(73) Assignee: HL Display AB, Nacka Strand (SE)

( * ) Notice: Subject to any disclaimer, the term of this patent is extended or adjusted under 35 U.S.C. 154(b) by 0 days.

(21) Appl. No.: 15/548,965

(22) PCT Filed: Feb. 5, 2016

(86) PCT No.: PCT/EP2016/052546
§ 371 (c)(1),
(2) Date: Aug. 4, 2017

(87) PCT Pub. No.: WO2016/124760
PCT Pub. Date: Aug. 11, 2016

(65) Prior Publication Data

US 2018/0020830 A1 Jan. 25, 2018

(30) Foreign Application Priority Data

Feb. 6, 2015 (EP) ..... 15154179

(51) Int. Cl.
*A47F 1/04* (2006.01)
*A47F 1/12* (2006.01)
(Continued)

(52) U.S. Cl.
CPC ..... *A47B 57/585* (2013.01); *A47B 96/021* (2013.01); *A47F 5/005* (2013.01);
(Continued)

(58) Field of Classification Search
CPC ... A47B 57/585; A47B 96/021; A47B 96/025; A47F 5/0018; A47F 5/005; A47F 5/0062; A47F 1/125; A47F 1/126
See application file for complete search history.

(56) References Cited

U.S. PATENT DOCUMENTS 3,579,710 A * 5/1971 Gartzke ..... A47B 57/26 16/93 R
4,782,960 A * 11/1988 Mavrakis ..... A47B 57/585 211/184
(Continued)

FOREIGN PATENT DOCUMENTS

CH 394537 6/1965
EP 0120099 10/1984
(Continued)

OTHER PUBLICATIONS

Bitton, A., International Search Report, parent PCT Application No. PCT/EP2016/052546, Apr. 22, 2016, European Patent Office, Rijswijk, NL.

*Primary Examiner* — Kimberley S Wright
(74) *Attorney, Agent, or Firm* — Babcock IP, PLLC

(57) ABSTRACT

System for fixation of shelf accessories to a shelf, the system comprising; —an elongate front fixation device (120, 220, 320, 420) having a longitudinal direction and being arranged to be fixed to a shelf (10), at or adjacent and in parallel with a front edge (11) of said shelf. The fixation device comprises at least one channel wall (123, 223, 323, 423) defining a longitudinally extending, open engagement channel (124, 224, 324, 424). At least one shelf accessory (140, 240, 340, 440, 640) is arranged to be supported on an upper surface of the shelf and comprising an engagement member (150, 250, 350, 450, 650) arranged to be brought into engagement with said channel wall, for fixation of the shelf accessory to the front fixation device and the shelf. The shelf accessory
(Continued)

comprises a resilient member (158, 258, 358, 458, 441*a*, 600) arranged to press the engagement member into an engaged position at which the engagement member is in engagement with the channel wall and to allow the engagement member to be brought to a disengaged position at which the engagement member is disengaged from the channel wall by deformation of the resilient member. The resilient member is arranged to contact the front fixation device both in the engaged position and in the disengaged position of the engagement member.

28 Claims, 15 Drawing Sheets

(51) Int. Cl.
*A47F 5/00* (2006.01)
*A47B 57/58* (2006.01)
*A47B 96/02* (2006.01)

(52) U.S. Cl.
CPC ..... *A47F 5/0018* (2013.01); *A47F 5/0062* (2013.01); *A47B 96/025* (2013.01); *A47F 5/0087* (2013.01)

(56) References Cited

U.S. PATENT DOCUMENTS 7,641,057 B2 * 1/2010 Mueller ..... A47F 1/126 206/221
7,918,353 B1 * 4/2011 Luberto ..... A47F 1/126 211/59.3
8,317,038 B2 * 11/2012 Luberto ..... A47F 1/126 211/59.3
8,746,468 B2 * 6/2014 Poulokefalos ..... A47F 5/005 211/59.3
9,538,860 B2 * 1/2017 Brej ..... A47F 1/126
9,770,121 B2 * 9/2017 Walker ..... A47F 1/125
9,955,802 B2 * 5/2018 Bird ..... A47F 1/125
2004/0118794 A1 * 6/2004 Hardy ..... A47F 1/126 211/59.3
2006/0260518 A1 * 11/2006 Josefsson ..... A47F 5/005 108/61
2007/0256997 A1 11/2007 Collins et al.
2009/0165342 A1 * 7/2009 Chasmer ..... A47F 5/0846 40/1
2011/0100941 A1 * 5/2011 Luberto ..... A47F 1/126 211/134
2011/0139736 A1 * 6/2011 Hardy ..... A47F 1/126 211/59.3
2011/0174750 A1 * 7/2011 Poulokefalos ..... A47F 1/126 211/59.3
2012/0111813 A1 * 5/2012 Hardy ..... A47F 1/126 211/59.3
2013/0270204 A1 * 10/2013 Bird ..... A47F 1/04 211/59.3
2014/0263133 A1 * 9/2014 Walker ..... A47F 5/005 211/184
2014/0263134 A1 * 9/2014 Walker ..... A47F 5/005 211/184
2016/0296038 A1 * 10/2016 Walker ..... A47F 1/125
2016/0296039 A1 * 10/2016 Bird ..... A47F 1/125
2018/0042402 A1 * 2/2018 Walker ..... A47F 1/125
2018/0213947 A1 * 8/2018 Bird ..... A47F 1/125

FOREIGN PATENT DOCUMENTS

WO 01/97660 12/2001
WO 2004/112549 12/2004
WO 2005/025386 3/2005
WO 2007/073294 6/2007
WO 2007/073295 6/2007
WO 2013/033555 3/2013

* cited by examiner

SYSTEM FOR FIXATION OF SHELF ACCESSORIES TO A SHELF

FIELD OF INVENTION

The present invention relates to a system for fixation of shelf accessories to a shelf.

The shelf accessories may be of different kinds, such as for instance shelf dividers, pushing devices, holders for information carriers, trays, etc.

BACKGROUND OF THE INVENTION

Stores that retail convenience goods or commodities on a daily basis often present their goods on shelves. In order to create an ordered display of these goods on the shelving and to enhance their presentation there is used a number of different shelf accessories, such as shelf dividers, different types of devices for pushing the goods and different types of goods-carrying trays, etc. Such accessories are often mounted on the upper surface of the shelf.

Known technology allows these accessories to be fastened to the shelf in a number of different ways, for instance mechanically with the aid of screws or technically equivalent devices, by frictional engagement or by adhesion with the aid of double-sided adhesive tape or by corresponding means.

The devices used to fasten the accessories to the shelves will preferably have some fundamental properties. One important property is that it is possible to fasten the accessories at selected positions along the length of the shelving, so as to position the accessories in a chosen space relationship that is adapted to suit different packages and different quantities of goods. The accessories should further be securely held to the shelf in order to avoid that they are inadvertently loosened or displaced from their intended positions.

Shelf dividers constitute an example of accessories where the mutual distance there between can be particularly important. The shelf dividers often consist of partitioning walls which are fastened to the shelving such as to extend at right angles to the longitudinal direction of the shelving and to project outwardly perpendicularly therefrom. The primary purpose of the shelf dividers is to separate different groups of goods from one another and to create order on the shelving. Particularly when a goods advancing means is placed between two shelf dividers, it is essential that the shelf dividers are not displaced towards one another, since the friction between goods and shelf dividers may then become so great as to prevent advancement of the goods.

The accessories will preferably also be held firmly, such as to ensure that they will not topple. In conjunction with this, it is important that the accessory is held firmly and that the fixing device enables respective accessories to be readily fixed and removed.

After setting up a shelf and positioning all accessories along the shelf, it is sometimes necessary to reorganize the shelf, requiring one or more of the shelf dividers to be removed or moved and fixed in a new position. For example, this is the case when the spacing between two adjacent shelf dividers must be adjusted in order to accommodate a new item of goods or package of goods of other dimensions. In addition, it may often be desirable to subsequently fasten other accessories, such as information carriers, for instance flag holders or coupon holders on a shelf that has earlier been placed in order. In order to facilitate such reorganization of parts of a shelf that has already been placed in order it is desirable that individual accessories can be removed and then secured in a new position and to affix new accessories without needing to release remaining shelf dividers.

An additional important aspect is that the fixation devices should be easy to use and especially that it should be easy for the personnel working with the devices to understand how to efficiently handle the devices when setting up and reorganizing shelves. I practice, personnel working with such organization of shelves rarely have the time to study mounting manuals and quite frequently they get little or no instructions or training concerning the handling of the various fixation arrangements that exist on the market. Quite often it happens that the mounting systems are used incorrectly or inefficiently, which may lead to additional work and thereby to reduced profitability for the shop owner. Therefore it is desirable that the construction of the fixation systems is simple such that it is self explanatory how to use the system just by the look of its constituent parts, even for personnel having no earlier experience of the system.

Depending on what products that are to be placed on the shelves, the shelves may have different depth dimensions in the horizontal direction, perpendicular to the front edge of the shelves. Accordingly, the shelf accessories need to exhibit corresponding lengths in order to reach over the shelves' entire depth. In practice, the shelve depths utilized in stores varies from 200 mm to 800 mm. In some occasions the shelf depth may be as large as 1000 mm, however at the majority of shelves for daily commodity stores the shelf depth varies between 400 an 700 mm. Especially at longer accessories, it might be difficult to prevent the rear end of the accessories from moving in the directions parallel to the longitudinal direction of the shelf, thereby causing the accessories to bend. Such bending may in turn cause disorder of the products on the shelf, hinder the functioning of pushers and cause other related problems. In order to prevent or alleviate such problems it might be necessary to provide the fixation systems for longer accessories with additional fixation devices that are arranged at the rear edge of the shelf. The accessories may then be provided with corresponding rear fixation means which are brought into engagement with the rear fixation device for separately fixing also the rear ends of the accessories to the shelf. However, such additional fixation arrangements for the rear end of the accessories naturally makes the systems more complex and thereby more expensive both to manufacture and to mount onto the shelves. Additionally, when setting up and reorganizing shelves provided with such rear fixation arrangements, it is necessary, for each accessory, to position and engage both ends of the accessory to a respective fixation device. This constitutes a cumbersome, time consuming and ergonomically disadvantageous operation, especially since it requires that at least one hand is stretched over the entire shelf depth to reach the rear edge of the shelf. It would thus be advantageous and desirable if also longer accessories could be satisfactory fixed and maintained at the shelf while utilizing only a front fixation device arranged at the front edge of the shelf.

It is also desirable that the means for fixating the accessories will have an aesthetic appearance and will not be an unnecessary obstacle to placing or removing goods on and from a shelf or from adjacent shelving. It is also important that the accessory fixing means are of simple construction and can be produced and mounted at low cost.

Further, it is desirable that the means for securely holding accessories to a shelf can be applied to existing shelves without requiring the shelves to be replaced or modified in some way.

PRIOR ART

The previously known systems for fixation of shelf accessories to a shelf may be divided into two basic categories. In a first category, the system comprises a main maneuverable fixation and release member by means of which a number of accessories may be simultaneously fixed to and released from the shelf. In a second category the system comprises individual fixation and release organs by means of which each accessory may be separately fixed to and released from the shelf.

WO 2004/112549 A, WO 2005/025386 A, WO 2007/073294 A and WO 2007/073295 A all describe systems generally belonging to the first category. These systems generally comprise an elongate profiled channel element which is attached to the front edge of a shelf and which is provided with a movable fixation organ that extends along the entire channel element. Each accessory is provided with a protruding foot, which may be inserted into the channel element. By moving the fixation organ between a release position and a fixation position all accessory feet inserted in the channel element may be simultaneously selectively engaged by and released from the fixation organ to thereby allow simultaneous fixation or release of all accessories.

A system according to the second category is described in EP 120 099 B2. This system comprises a catching device which extends along the front edge of the shelf and which has a U-shaped cross section. The free ends of the legs forming the U-shape are provided with inwardly directed edges forming there between a slot for interlocking insertion of a locking projection with a broadened portion of a shelf divider.

WO 2013/033555 A1 discloses inter alia an arrangement comprising a front rail and a divider. The front rail exhibits a channel provided with first teeth and a longitudinal ridge. The divider comprises a barrier with a front portion which may be received in the channel. When so inserted the ridge of the front rail is received in a groove of the divider. The divider further comprises a resilient tab provided with second teeth. When the front portion of the divider is inserted in the channel of the front rail and the resilient tab is not actuated the second teeth engage between the first teeth, thereby preventing displacement of the divider along the front rail. By pushing the resilient tab away from the first teeth the second teeth are disengaged from the first teeth, thereby allowing displacement of the divider along the front rail.

SUMMARY OF THE INVENTION

It is an object of the present invention to provide an enhanced system for fixation of shelf accessories to a shelf.

Another object is to provide such as system by means of which any number of accessories may be individually fixed to and released from the shelf.

A further object is to provide such a system which is easy and ergonomically advantageous to use.

Still another object is to provide such a system at which the shelf accessories may readily be repositioned by using comparatively small forces and little effort.

Still a further object is to provide such a system which requires no instructions or training also for untrained personnel in order to be able to efficiently use the system.

Yet another object is to provide such a system which achieves satisfactory fixation also of comparatively long accessories without the need of any fixation arrangements being used at the rear end of the accessories.

A further object is to provide such a system which is reliable and comprises a low number of moving parts.

Another object is to provide such a system which is simple in construction, and which may be manufactured at a low cost.

These and other objects of the invention are achieved with a system of the kind defined in the preamble of claim 1 and having the special technical features set out in the characterising portion of the claim. The inventive system is used for fixation of shelf accessories to a shelf. The system comprises an elongate front fixation device having a longitudinal direction and being arranged to be fixed to a shelf, at or adjacent and in parallel with a front edge of said shelf, said front fixation device comprising at least one channel wall defining a longitudinally extending, open engagement channel. At least one shelf accessory is arranged to be supported on an upper surface of the shelf and comprises an engagement member arranged to be brought into engagement with said channel wall, for fixation of the shelf accessory to the front fixation device and the shelf. The shelf accessory comprises a resilient member arranged to press the engagement member into an engaged position at which the engagement member is in engagement with the channel wall and to allow the engagement member to be brought to a disengaged position at which of the engagement member is disengaged from the channel wall by deformation of the resilient member. The resilient member is further arranged to contact the front fixation device both in the engaged position and in the disengaged position of the engagement member The system thus allows for that each accessory may be individually fixed to and released from the front fixation device. The arrangement of the resilient member further provides for that the accessory is automatically locked in position once the engagement member as been inserted into the engagement channel. Additionally, the arrangement of the resilient member allows for that the accessory may easily be displaced along the front fixation device by simply compressing the resilient member and moving the accessory to any desired position along the shelf. Such repositioning is readily accomplished by using only one hand or even only one finger. The arrangement of the resilient member to be in contact with the front fixation device both in the engaged position and in the disengaged position allows for that the resilient member may function as a friction decreasing means during displacement of the accessory. The resilient member may thus comprise or be entirely formed of a material which exhibits comparatively low friction when in contact with the corresponding contact surface of the front fixation device. By this means the force required for displacing the accessory along the front fixation device is reduced, which in turn facilitates repositioning of the accessory.

The system further comprises a low number of separate parts and may readily be manufactured at a low cost. The very simple construction further contributes to that the operators easily and intuitively understand the functioning of the system and that the system may be fully operated without the need of any training or studying of instruction manuals or the like.

The engagement member may comprise an engagement flange arranged to be received in the engagement channel.

The front fixation device may comprise a longitudinally extending guide flange and the shelf accessory may exhibit a guide channel arranged to receive the guide flange.

The guide flange and the guide channel may be arranged such that the guide flange is received in the second channel with a close fit.

The length of the guide channel may preferably be greater than ⅛ of the length of the accessory in a direction perpendicular to the longitudinal direction of the guide channel.

The resilient member may be arranged to assume a first predetermined shape when unloaded and a second predetermined collapsed shape when loaded by a force greater than a certain threshold force.

The resilient member may, when assuming the collapsed shape, be supported by the shelf accessory such that loading the resilient member with a force greater than the threshold does not cause any further appreciable deformation of the resilient member. By this means it is possible to avoid other parts of the shelf accessory than the resilient member to come into frictional contact with the front fixation device also when the resilient member is compressed for moving the engagement member to the disengaged position. Thereby substantially only the friction between the resilient device and the front fixation device hinders longitudinal displacement of the shelf accessory along the front fixation device.

The resilient member may comprise a separate part which is fixed to the engagement member.

The resilient member may comprise a leaf spring.

The leaf spring may comprises a weakened portion.

The leaf spring may e.g. be rectangular and the weakened portion may be arranged at a mid portion of the leaf spring.

The weakened portion may comprise a through hole arranged in the leaf spring.

The leaf spring may be fixed to the shelf accessory at opposite end portions of the leaf spring and the shelf accessory may comprise a support surface arranged to support a portion of the leaf spring when the leaf spring has been deformed from its unloaded shape by applying a compression force.

Alternatively or in combination, the resilient member may comprise an integral part of the engagement member.

The resilient member may then comprise a resilient arm having a free end which is arranged to bear against the front fixation device.

Alternatively or in combination, the resilient member may comprise a weakened portion of the engagement member.

The resilient member may be arranged at or in proximity to the engagement flange.

The resilient member may be positioned in the guide channel and arranged to bear against the guide flange.

The accessory may be provided with a downwardly projecting pivot member which is arranged to be supported by the upper surface of the shelf and which defines a pivotal axis being parallel to the longitudinal direction of the front fixation device, for allowing at least a front portion of the accessory to pivot about the pivotal axis when the engagement member is brought out of engagement from the channel wall.

The pivotal member may comprise a downwardly projecting rib which extends perpendicular to the longitudinal direction of the accessory.

The pivotal axis may be arranged between 100 and 300 mm, preferably between 150 and 250 mm from a front edge of the accessory.

The engagement member and the engagement wall may be provided with co-operating engagement means arranged to prevent displacement of the shelf accessory in the longitudinal direction of the front fixation device when the engagement member is in engagement with the engagement wall.

The engagement means may comprise teeth and/or a friction increasing elastic layer provided on the engagement member and the engagement wall.

The engagement means may e.g. comprise interacting teeth provided on both of the engagement member and the engagement wall.

Alternatively, the engagement means may comprise teeth arranged on one of the engagement member and the engagement wall and a friction increasing elastic layer arranged on the other of the engagement member and the engagement wall.

The front fixation device and the engagement member may constitute the only means for fixing the shelf accessory to a shelf. Hereby all the problems associated with additional fixation means arranged at the rear edge of the shelf are removed.

The invention also concerns a shelf accessory for use with a system according to the system.

Further objects and advantages of the invention appear from the following detailed description of embodiments and from the appended claims

BRIEF DESCRIPTION OF THE DRAWINGS

The present invention will now be described with reference to various embodiments thereof and also with reference to the figures of the accompanying drawings, in which.

DETAILED DESCRIPTION OF EMBODIMENTS

There have been used in the following description directional and positional designations, such as up, down, forwards, rearwards, over, under, in front of, behind, upper, lower, front and rear. These designations relate to directions and positions of a horizontal shelf or of details when fixed to such a shelf. By the front edge of a shelf is meant that edge of the shelf that faces towards a person in normal use of the shelf. The designations are used to provide greater clarity to this description and shall not be considered to limit the protective scope of the claimed invention.

Figure 1:
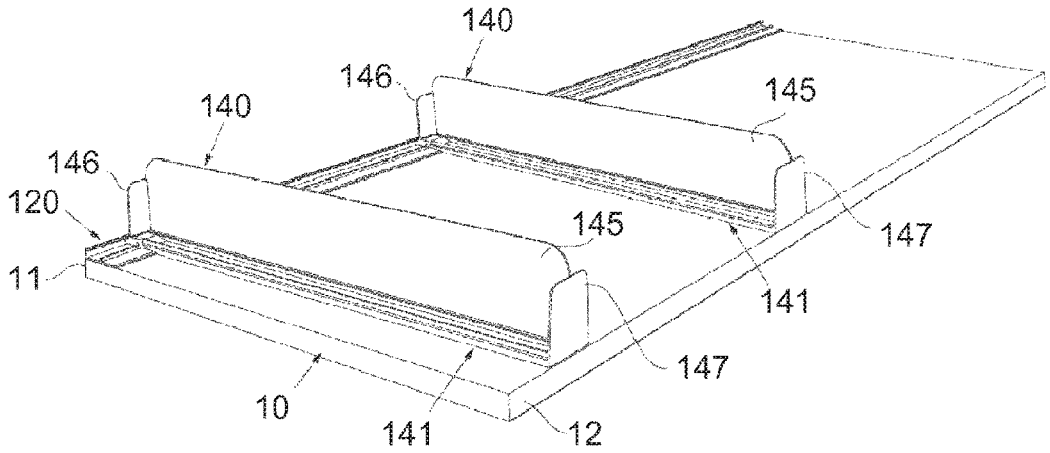
FIG. 1 is a perspective rear view of a shelf provided with a system according to a first embodiment of the invention and comprising one front fixation device and two accessories.

FIG. 1 shows a shelf 10 and a system according to a first embodiment of the invention. The system comprises a front fixation device 120 and two shelf accessories 140 in the form of shelf dividers.

The shelf is made of steel and exhibits a front edge 11 and a rear edge 12. In use, the front edge 11 faces the shop alley from where customers may pick products (not shown) placed on the shelf.

Figure 2:
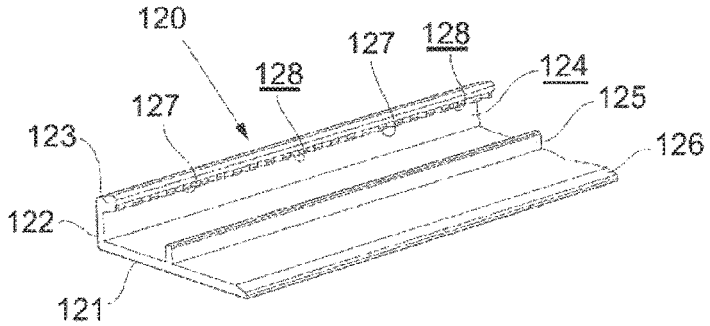
FIG. 2 is a perspective view illustrating a portion of the front fixation device shown in FIG. 1.

A portion of the front fixation device 120 is shown more in detail in FIG. 2. The front fixation device 120 is formed as an elongate profiled strip which has a longitudinal direction that, when mounted to the shelf, extends in parallel with the longitudinal direction of the shelf 10. The front fixation device may be manufactured of a polymer material such as e.g. ABS, PET, PVC or PU. In the shown example it has been manufactured by injection moulding but other manufacturing processes such as extrusion are also possible. It may be manufactured at any suitable length and cut on site to the correct length suited for the shelf in question. Normally a single fixation device extends along the entire length of the shelf or a shelf section. It is however also possible that several shorter fixation devices are arranged one after the other along the front edge of the shelf.

The front fixation device 120 comprises a bottom plate 121 and a front wall 122 which extends vertically upwardly from the front edge of the bottom plate 121. An engagement wall 123 extends somewhat obliquely, rearwards and upwards from the upper edge of the front wall 122. By this means an elongate rearwardly open engagement channel 124 is defined by a front portion of the bottom plate 121, the front wall 122 and the engagement wall 123. The engagement channel 124 thus extends in parallel with the longitudinal direction of the front fixation device 120 and the shelf 10, when mounted thereto. A guide flange 125 protrudes upwardly from a mid portion of the bottom plate 121, behind the engagement channel 124, and extends in the longitudinal direction of the front fixation device 120. The rear edge 126 of the bottom plate 121 is bevelled such that it tappers rearwardly. In the shown example the front fixation device 120 is attached to the upper surface of the shelf 10 by means of double sided adhesive tape (not shown) which is adhered to the lower side of the bottom plate 121. Many other means of fixating the front fixation device to the shelf is however also possible. Such fixation may e.g. be accomplished by means of screws, rivets, glue or by press fitting or snap fitting of co-operating fixation means arranged at the front fixation device and the shelf. The shelf may for instance be provided with a fixation channel or with fixation recesses or apertures and the front fixation device with corresponding protruding press fitting or snap fitting engagement members which may be engaged with the fixation means arranged at the shelf.

The inner surface of the engagement wall 123 is provided with a number of first teeth 127 which are arranged one after the other along the engagement wall and which extend perpendicular to the longitudinal direction of the front fixation device 120. By this means the first teeth 127 form them between a corresponding number of first recesses 128, which extend in parallel with the first teeth 127.

Figure 3A:
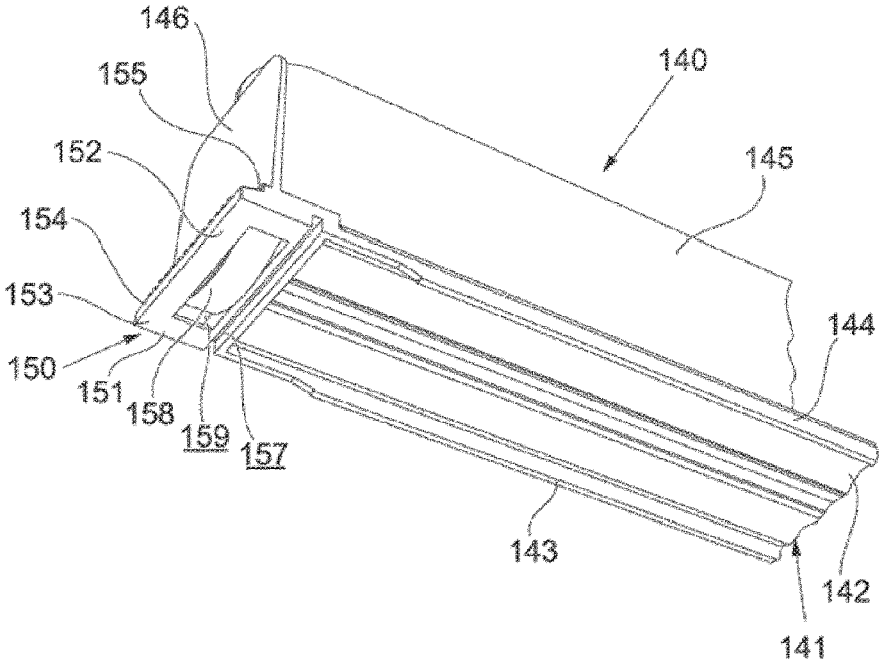
FIGS. 3*a* and 3*b* are perspective views illustrating a front portion of one of the accessories shown in FIG. 1
Figure 3B:
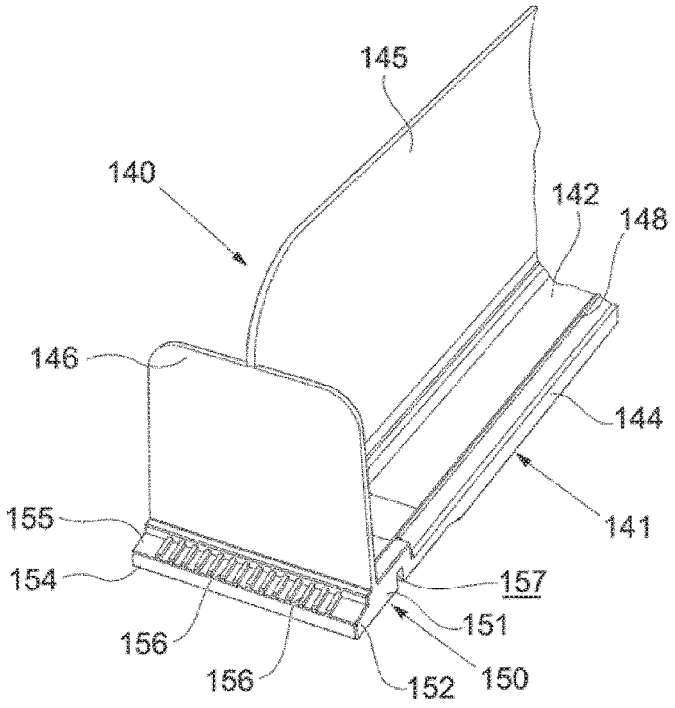

A portion of a shelf accessory 140 forming part of the system according to the first embodiment and shown in FIG. 1 is shown more in detail in FIGS. 3*a* and 3*b*. The exemplifying shelf accessory 140 constitutes a shelf divider. It comprises a base member 141 which is arranged to be supported on the upper surface of the shelf. The base member 141 has a generally box shaped configuration with a horizontal top wall 142 and two downwardly projecting side walls 143, 144. The side walls 143, 144 are mutually connected by a rear wall (not shown). The lower edges of the side walls 143, 144 and the rear wall are arranged to bear against the upper surface of the shelf 10 and define a support plane. A vertical dividing wall 145 projects upwardly from the upper side of the base member 141 and extends over essentially the entire length of the accessory 140, perpendicular to the longitudinal direction of the shelf and the front fixation device, when mounted. A vertical front stop wall 146 and rear stop wall 147 (see FIG. 1) are arranged at the front end and rear end respectively of the dividing wall 145. An upwardly projecting slide flange 148 (only one of which is shown) is arranged on the upper surface of the base member 141, at each side of the dividing wall 145 and extend in the longitudinal direction of the base member 141. The slide flanges 148 are arranged to support products placed on the shelf and to facilitate forward movement of the products, e.g. by means of a pusher (not shown) such as known per se.

An engagement member 150 is arranged at the front portion of the base member 141. The engagement member 150 comprises a generally rectangular body portion 151, the rear portion of which is formed integral with the front portion of the base member 141. The lower portion of the front stop wall 146 is formed integral with an upper portion of the body portion 151. A forwardly projecting engagement flange 152 is arranged at a front portion of the body portion 151. The engagement flange 152 exhibits a horizontal bottom surface 153, a vertical front surface 154 and a forwardly, downwardly inclined top surface 155. The angle of inclination of the top surface 155 corresponds to the angle of inclination of the front fixation device's 120 engagement wall 123. A number of second teeth 156 protrude upwardly from the top surfaces 155. The dimensions and orientation of the second teeth correspond to the dimensions and orientation of the first recesses 128 such that the second teeth 156 may be received in the first recesses 128 with a close fit.

The front portion of base member's 141 side walls 144 tappers forwardly in correspondence with the bevelled rear edge 126 of the front fixation device 120. Additionally, the bottom surfaces of the engagement member's 150 body portion 151 and engagement flange 152 are raised a distance which corresponds to the vertical thickness of the front fixation device's 120 bottom plate 121, in relation to the support plane defined by the lower edges of the base member's 141 side walls 143, 144. By this means the engagement member 150 may be positioned slightly above or on top of the front fixation device's 120 bottom plate 121 when the lower edges of the base member's side walls 143, 144 are in contact with the upper surface of the shelf 10.

The engagement member 150 is further provided with a downwardly open guide channel 157 which extends perpendicular to the longitudinal direction of the accessory and in parallel with the longitudinal direction of the front fixation device 120, when mounted. The horizontal width of the guide channel 157 corresponds to the horizontal width of the guide flange 125, such that the guide flange 125 may be received with a close fit in the guide channel 157. However, the vertical depth of the guide channel 157 is somewhat greater than the vertical height of the guide flange 125, such that the engagement member 150 may be displaced somewhat vertically in relation to the front fixation device, while the guide flange 125 still being engagingly received in the guide channel 157.

The shelf accessory 120 further comprises a resilient member 158. In the embodiment shown in FIGS. 1 to 5*b*, the resilient member is constituted by a leaf spring formed of spring steel. The resilient member 158 is received in a downwardly open spring recess 159 arranged in the engagement member 150. The resilient member 158 is fastened to the engagement member 150 by means of its end portions being received in respective slots (not shown) formed in the engagement member 150, at the bottom of the spring recess 159. The resilient member 158 is pretensioned such that a mid portion of the leaf spring convexly protrudes out from the spring recess 159, passed the lower surface of the engagement member iso, when the resilient member is not under influence of any external force. The pretension of the resilient member 158 is chosen such that compression of the resilient member by moderate forces will deform the resilient member such that the protruding portion of the resilient member will move towards the shelf accessory and the spring recess 159. However the pretension is also preferably chosen such that also comparatively high compression forces will deform the resilient member on to a certain degree at which a portion of the resilient member still protrudes out from the spring recess 159, passed the lower surface of the engagement member 150. By this means the lower surface of the engagement member 150 will be maintained at a certain distance from the bottom plate 121 of the front fixation device 120 also when the resilient member has been compressed by comparatively high forces.

The operation of the system according to the first embodiment will now be described with reference mainly to FIGS. 1, 4*a*, 4*b*, 5*a* and 5*b*. When utilizing the system, the front fixation device 120 is first attached to the shelf, along the front edge 11 by means of a double sided adhesive tape (not shown). For fixing a shelf accessory 140 to the shelf 10, the engagement flange 152 of the accessory's engagement member 150 is introduced into the engagement channel 124 of the front fixation device 120, while maintaining the rear portion of the accessory 140 above the upper surface of the shelf 10 such that the lower surface and the protruding resilient member 158 of the engagement member 150 go free from the guide flange 125. Once the engagement flange 152 has been introduced into the engagement channel 124, the rear portion of the accessory is pivoted downwards, such that the lower edges of the side walls' 143, 144 rear portions are supported by the shelf. In this position (shown in FIGS. 4*a* and 5*a*) an upper portion of the guide flange 125 is received in the guide channel 157. Additionally, the protruding mid portion of the pretensioned resilient member 158 makes contact with the upper surface of the front fixation device's 120 bottom plate 121. By this means, the resilient member urges the top surface 155 of the engagement flange 152 into contact with the lower side of the front fixation device's 120 engagement wall 123. The second teeth 156 are introduced into the first recesses 128, such that a form locking effect is achieved. Thus, in this position it is not possible to displace the accessory along the longitudinal direct of the front fixation device 120 and the shelf 10.

Figure 4A:
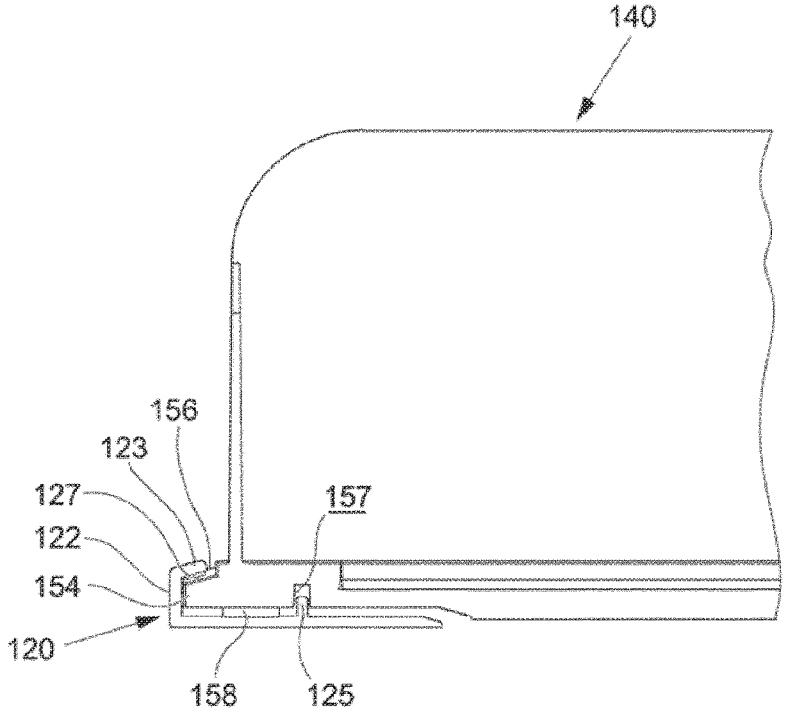
FIGS. 4*a* and 4*b* are side views illustrating the front fixation device and a front portion of an accessory in two different operational positions.
Figure 4B:
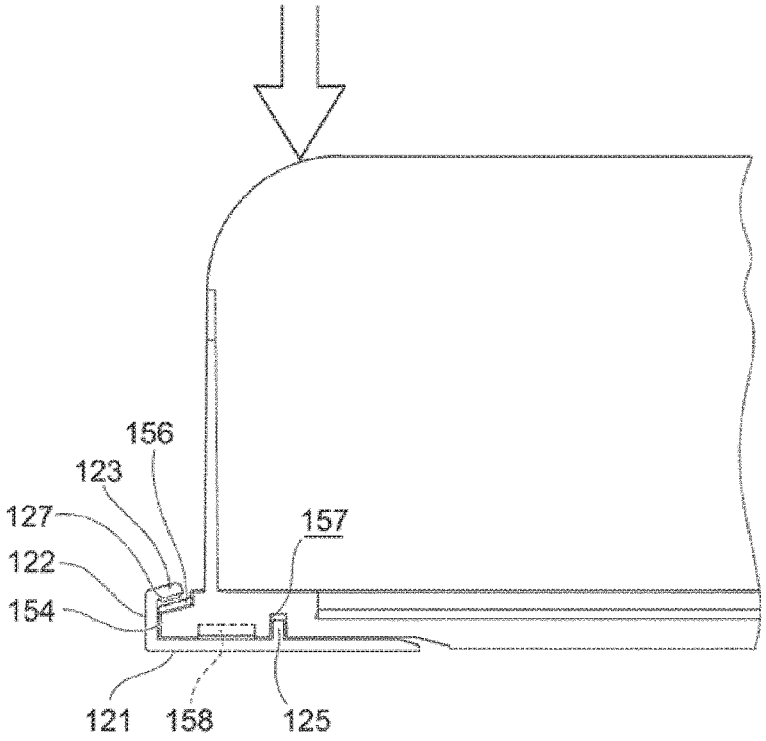
Figure 5A:
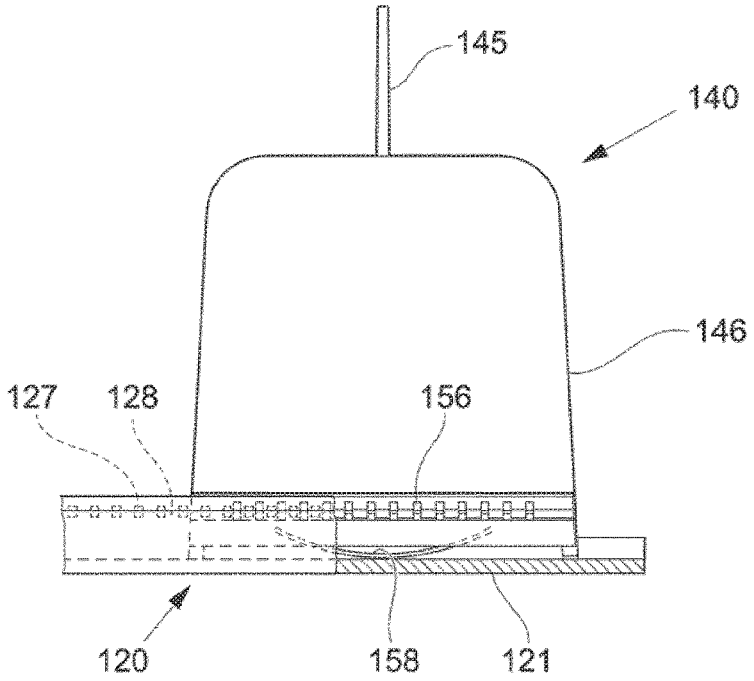
FIGS. 5*a* and 5*b* are front views corresponding to FIGS. 4*a* and 4*b* respectively and partly transparent, with some parts cut away
Figure 5B:
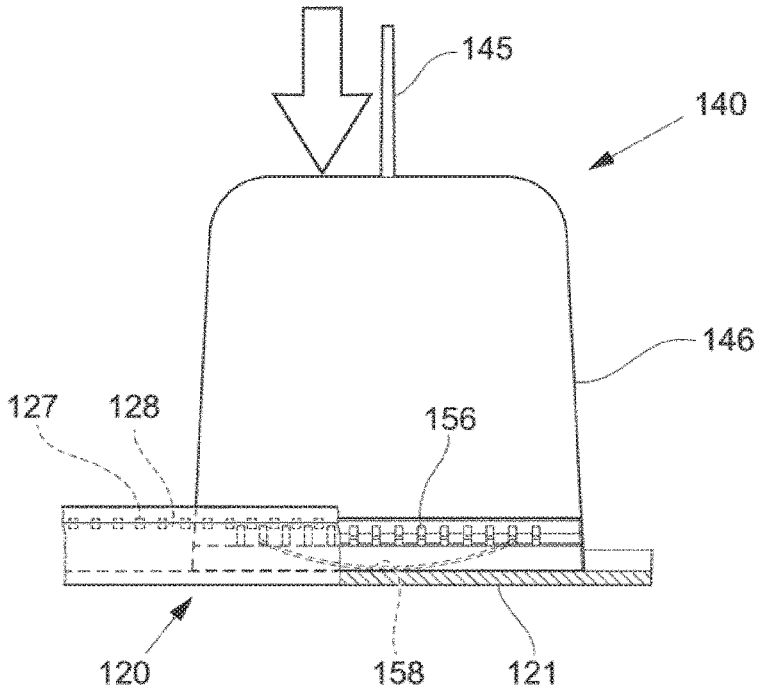
Figure 6:
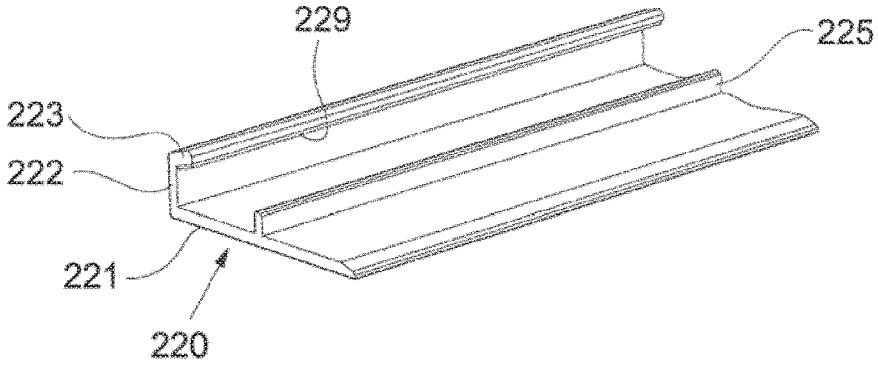
FIG. 6 is a perspective view of a portion of a front fixation device forming part of a system according to a second embodiment of the invention.

The accessory may now readily be displaced along the shelf 10 and the front fixation device 120. Such displacement is accomplished simply by applying a downwardly directed force onto a front portion of the accessory, such as indicated in FIGS. 4*b* and 5*b*. E.g. the operator may use a finger to push downwardly on a front portion of the dividing wall 145 (FIG. 4*b*) or on the front stop wall 146 (FIG. 5*b*). Thereby, the resilient member 158 will be compressed and the engagement member 150 will be pushed downwardly, against the biasing force of the resilient member 158 until the lower surface of the engagement member 150 bears against the upper surface of the base plate 121. By this means, the second teeth 156 are brought out of engagement with the first recesses 128 and the entire accessory 140 is thereby free to be displaced to any desired position along the front fixation device 120. It should be noted that in this depressed position of the engagement member iso, the guide flange 125 is fully introduced into the guide channel 157, such that the accessory is guided rectilinearly along the front fixation device 120 during the displacement. The inventive system thus allows for a very easy fixation, positioning and repeated re-positioning of the shelf accessories.

It may be however be preferable to choose the pretension of the resilient member sufficiently high for preventing that the lower surface of the engagement member 150 is brought into contact with the upper surface of the base plate 121 also when a moderate compression force is applied. Naturally, the moderate force should still be able to compress the resilient member 158 to such a degree that the engagement between the second teeth 156 and the first recesses is released, such that the self accessory may be displace along the front fixation device. By such an arrangement, only the friction between the low friction resilient member and the upper surface of the bottom plate 121, will imped displacement of the shelf accessory along the front fixation device. Thereby, relocation of the shelf accessory along the shelf is greatly facilitated.

It should also be noted that the engagement of the guide flange 125 in the guide channel 157, both in the non-depressed position (FIGS. 4*a*, 5*a*) and in the depressed position (FIGS. 4*b*, 5*b*), prevents the accessory 140 from pivoting in the horizontal plane. Hereby, the rear portion of the accessory 140 will always be positioned at the desired position, perpendicular to the front fixation device 120, behind the engagement member 150. The accessories 140 will thus always be maintained oriented generally perpendicular to the front fixation device 120 and in parallel with each other, such as to prevent any disorder of the goods placed on the shelf or any jamming of the products e.g. when utilizing forward feeding pushers.

This rigidifying or stiffening effect is further improved if the distance between guide flange 125 and the front wall 122 is chosen essentially equal to the distance between the guide channel 157 and the vertical front surface 154 of the engagement member iso. Hereby the guide flange 125 will be in contact with the vertical inner walls of the guide channel 157 at the same time as the vertical front surface 154 will be in contact with front wall 122. By this means the engagement between the engagement member 150 and the front fixation device 120 enhances the ability of the arrangement to withstand any torque applied to the engagement member when the accessory is pivoted in the horizontal plane.

The ability of such an arrangement to withstand such torques is dependent on the contact length between the engagement member 140 and the front fixation device. The length of the guide channel 157 and the vertical front surface 154 should preferably be chosen equal to or larger than ⅛ of the length of the accessory. It has proven that with such a relation, the engagement between the engagement member 150 and the front fixation device is rigid enough to eliminate totally the need of any fixation of the rear end of the accessory to the shelf. As described above, this entails for further a great advantage. It should be noted however that the engagement between the engagement member and the front fixation devices should preferably be made with some play, such that the friction does not obstruct displacement of the accessory along the front fixation device when the accessory has been depressed t the release position.

At the above described embodiments it may also be noted that when heavy products are placed on the base member 141 of the accessory 140, the weight of the products may result in a compression force which exceeds the moderate force needed to release and displace the shelf accessory. Such great forces may thus completely exceed the spring force of the pretensioned resilient member 158, such that the accessory is depressed to the release position shown in FIGS. 4*b* and 5*b*. In such a case, the weight of the products will increase the friction between the lower edges of the side walls 143, 144 and the upper surface of the shelf 10, such that any unintentional displacement of the accessory along the front fixation device 120 is prevented. However, in cases where it is desired that the accessory is maintained in the engagement position also when heavy products are placed on the base member of the accessory, an accessory according to the fourth or fifth embodiment described below, may advantageously be used.

The second embodiment of the system shown in FIGS. 6 to 8*b* differs from the previously described embodiment only by the following features. In this embodiment the resilient member 258 is formed as a narrower leaf spring which is arranged in the guide channel 257. The ends of the leaf spring are received in a respective slot (not shown) arranged at the bottom of the guide channel 257. Further, the first teeth have been replaced by a layer of an elastic friction increasing material 229 which is applied to the inner surface of the engagement wall 223.

The functioning and operation of this system is essentially the same as the system previously described. However, here the convex mid portion of the resilient member 258 bears against the upper edge of the guide flange 225, instead of against the upper surface of the base plate of the front fixation device. An additional difference is that, in the engagement position shown in FIG. 8*a*, displacement of the accessory 240 along the front fixation device 220 is prevented by means of the teeth 256 making contact with and deforming the friction increasing layer 229. This embodiment may provide a somewhat smaller prevention of longitudinal displacement when the accessory is in the non-depressed engagement position. However, the replacement of first teeth by a friction increasing layer on the front fixation device facilitates manufacturing of the front fixation device. Even though it may by possible to form the first teeth 127 and the recesses 128 on the front fixation device 120 according to the first embodiment during an extrusion process, such a formation may cause certain manufacturing difficulties. With the front fixation device 220 according to the second embodiment, the entire front fixation device may readily be manufactured by co-extrusion of a first material forming the base plate 221, the front wall 222, the engagement wall 223 and the guide flange 225 together with a second elastic material forming the friction increasing layer 229.

At the third embodiment shown in FIGS. 9-11*b*, the engagement member 350 comprises two resilient members 358, each in the form of a resilient arm. A respective first end 358*a* of the resilient arms is formed integral with a front portion of the engagement member 350. The resiliency of the arms allows the free second ends 358*b* to move pivotally in relation to the engagement member 350. The second ends 358*b* are further provided with a downwardly protruding bead 358*c* which, in the non-loaded state, is arranged below the lower surface of the engagement member 350. In the non-depressed position shown in FIG. 11*a*, the beads 358*c* bear against the upper surface of base plate 321 and force the top surface 355 of the engagement flange 352 into engagement with the engagement wall 323 of the front fixation device 320. By pushing the front portion of the accessory 340 downwards, it is possible to deform the resilient arms, such that the free second ends 358*b* pivots and the engagement member is moved downwards until the lower surface of the engagement member 350 makes contact with the upper surface of the base plate 321. By this means the top surface 355 is brought out of engagement from the engagement wall 323 and the accessory is released to be displaced along the front fixation device.

Just as in the previously described embodiments, the resiliency of the arms 358 may preferably be chosen such that moderate compression forces allows the engagement member to be brought out of engagement from the front fixation device but still prevents that the lower surface of the engagement member makes contact with the base plate 321 of the front fixation device.

It is also preferred that the beads 358*c* comprises or are formed of a material which exhibits low friction relative to the material forming the base plate 321 of the front fixation device 230. By this means repositioning of the shelf accessory along the front fixation device is greatly facilitated.

At this embodiment, just as in the first embodiment, the engagement wall 323 is provided with teeth 327 and recesses 328, whereas the top surfaces 355 of two engagement flanges are provided with a layer 359 of an elastic friction increasing material. Just as in the second embodiment, the combination of teeth and a friction increasing layer prevents longitudinal displacement of the accessory when the engagement member 350 is in the non-depressed engagement position shown in FIG. 11*a*. This embodiment provides inter alia the advantage that the entire accessory including the resilient members may readily be manufactured in a single injection moulding operation of two materials, wherein one material form the friction layer and the other material forms the other portions of the accessory.

In a not shown embodiment, an accessory provided with resilient arms (as in the third embodiment) may comprise second teeth (as in the first embodiment) cooperating with the first teeth and recesses on the front fixation member. At such an embodiment the entire accessory may readily be injection moulded of a single material.

Figure 12:
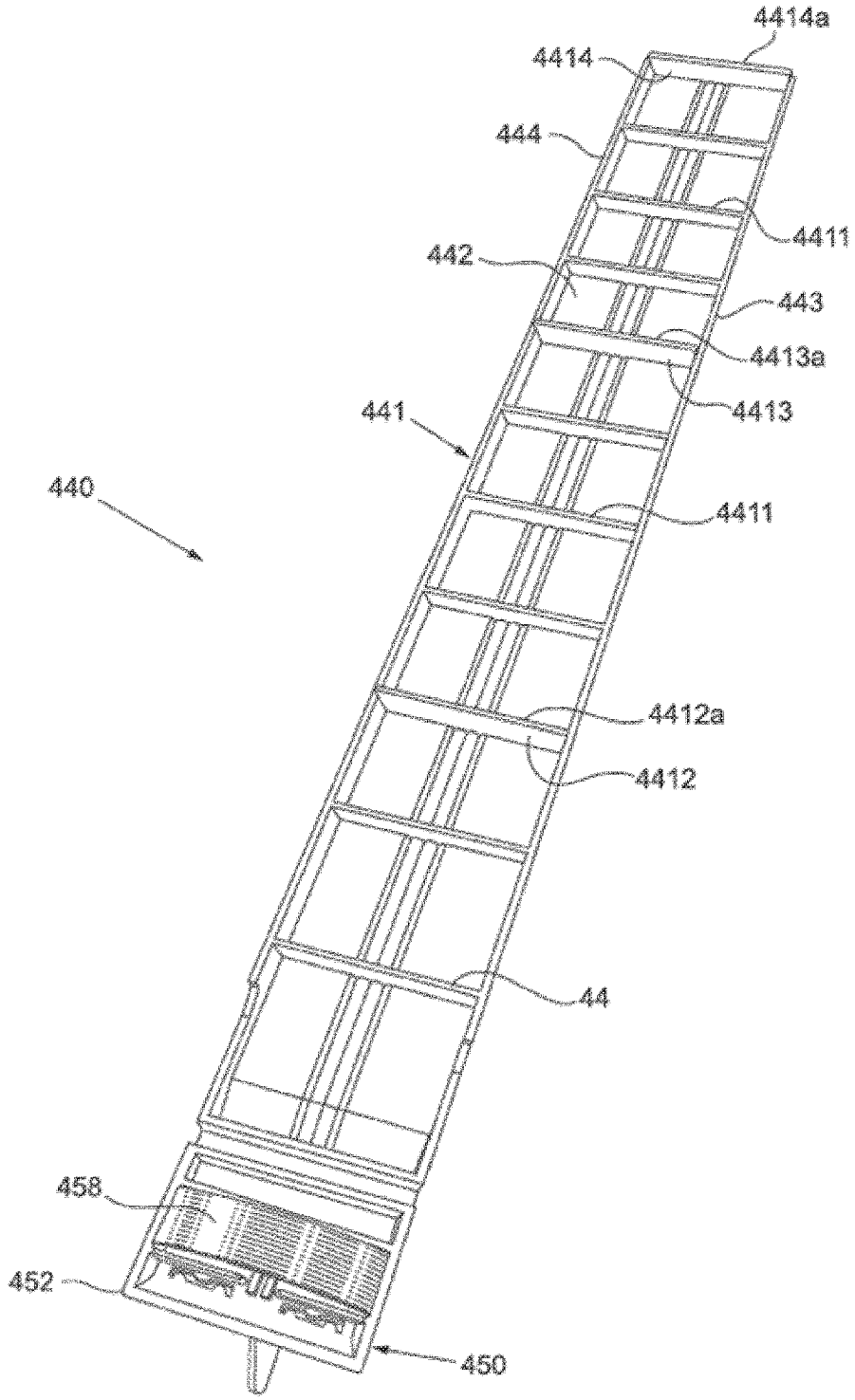
FIG. 12 is a perspective view from below of a shelf accessory forming part of a system according to a fourth embodiment of the invention.

The fourth embodiment of the invention will now be described with reference to FIGS. 12-14*b*. In FIG. 12 a shelf accessory 440 according to the fourth embodiment is shown in a perspective view from below. It comprises a base member 441 which is arranged to be supported on the upper surface of the shelf. The base member 441 has a generally box shaped configuration with a horizontal top wall 442 and two downwardly projecting side walls 443, 444. The side walls 443, 444 are mutually connected by a number of transverse walls 4411, 4412, 4413, 4414, which extend perpendicular to the longitudinal direction of the accessory 440. The transverse walls comprises a number of first transverse walls 4411 and three second transverse walls 4412, 4413, 4414.

The heights of the first transverse walls 4411 are equal to the heights of the side walls 443, 444 such that the lower edges of these walls 443, 444, 4411 are arranged in the same horizontal plane. The heights of the second transverse walls 4412, 4413. 4414 are greater than the heights of the first transverse walls 4411 and the side walls 443, 444, such that a lower edge 4412*a*, 4413*a*, 4414*a* each second transverse wall projects below said horizontal plane. Said lower edges 4412*a*, 4413*a*, 4414*a* thus form contacts surfaces by which the accessory is supported on top of the shelf.

The accessory 440 also comprises an engagement member 450. The engagement member 450 is arranged to cooperate with a front fixation device 420 (see FIG. 13*a*-14*b*). Both the engagement member 450 and the front fixation device 420 corresponds closely to the engagement member 150 and front fixation device 120 shown in FIGS. 2-5*b*. The engagement member 450 is thus provided with an engagement flange 452 which may be brought in and out of engagement with an engagement wall 423 of the front fixation device. A resilient member 458 in the form of a leaf spring is arranged to bear against an upper surface of a bottom plate 421 of the front fixation device 420 in order to urge the engagement flange 452 into engagement with the engagement wall 423 and to allow release of said engagement by applying a force which resiliently deforms, i.e. compresses, the resilient member 458.

The main difference of this embodiment compared to the embodiments described above, is that the lower edge 4412*a* of the foremost second transverse walls 4412 constitutes a pivotal member which allows the entire accessory to pivot about a pivotal axis when the resilient member is deformed. The pivotal axis is defined by the lower edge 4412*a* of the foremost second transverse wall 4412 and thus extends perpendicular to the longitudinal direction of the accessory and in parallel with the longitudinal direction of the front fixation device 420.

Figure 13A:
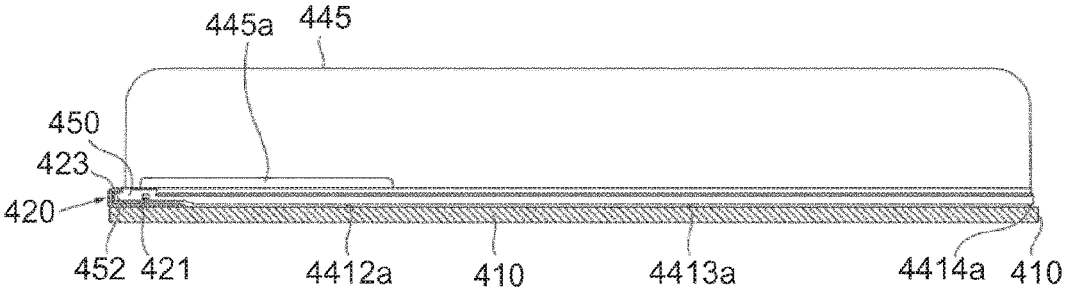
FIGS. 13*a* and 13*b* are side views illustrating the accessory shown in FIG. 12 and a front fixation device and illustrate the accessory in two different operational positions.
Figure 13B:
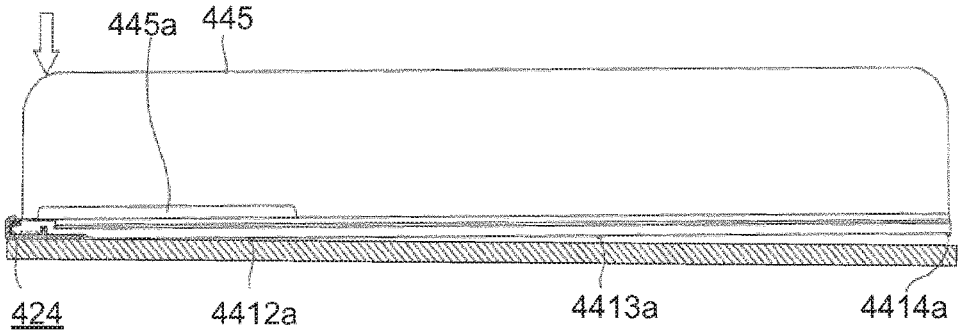

The functioning of the fourth embodiment will now be explained with reference to FIGS. 13*a*-14*b*. FIGS. 13*a* and 13*b* illustrates the system mounted to a shelf 410, without any products being placed on the shelf 410. These figures thus represent e.g. the situation when setting up a new shelf. For fixing the accessory 440 to the fixation device 420, the rear end of the accessory is positioned slightly above the top surface of the shelf 410 and the engagement flange 452 is introduced into the engagement channel 424 of the front fixation device 420, while compressing the resilient member 458. By lowering the rear portion of the accessory, the lower edge 4412*a* of the foremost second transverse wall 4412 will contact the upper surface of the shelf 410. Continued lowering of the rear end of the accessory 440, will cause the entire accessory to pivot clock-wise (as seen in the figures) about the pivotal axis defined by said lower edge 4412*a*. The accessory then assumes the position shown in FIG. 13*a*, where the lower edges 4412*a*, 4413*a*, 4414*a* of all second transverse walls 4412, 4413, 4414 rest against the upper surface of the shelf 410 and the resilient member 450 urges the engagement flange 452 into engagement with the engagement wall 423. Now, when the accessory is to be displaced along the shelf 410 to any desired position, a compressing force is applied to the front end of the accessory. This will cause the resilient member 458 to deform and the engagement flange 452 to be brought out of engagement from the engagement wall 423. Simultaneously, the entire accessory will be slightly pivoted anti-clockwise (as seen in the figures) about the pivotal axis, such that the middle 4413*a* and rearmost 4414*a* lower edges of the respective second transverse walls 4413, 4414 are slightly lifted above the shelf. The accessory 440 has then assumed the position shown in FIG. 13*b*. In this position it is possible to displace the accessory to any desired position along the shelf. Once the desired position has been reached, the downward force onto the front of the accessory is released, whereby the accessory reassumes the position shown in FIG. 13*a*, by clockwise rotation about the pivotal axis.

Figure 14A:
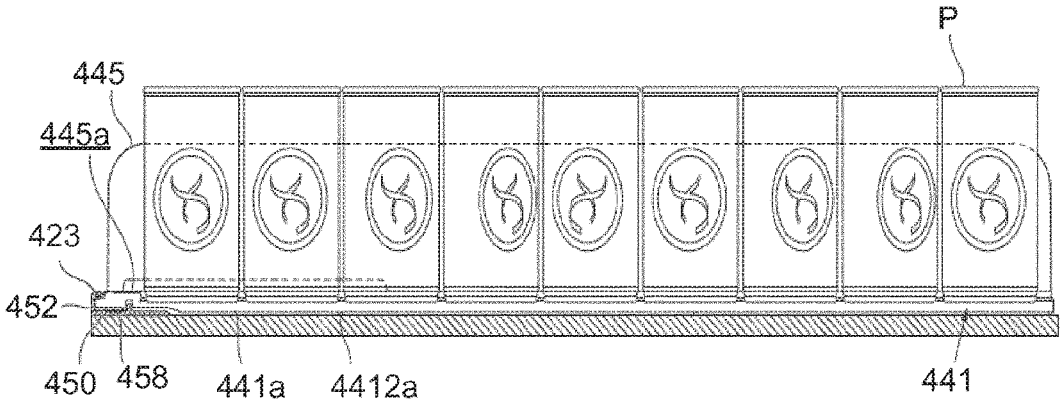
FIGS. 14*a* and 14*b* are side views corresponding to FIGS. 13*a* and 13*b* and shows the system when loaded with products.
Figure 14B:
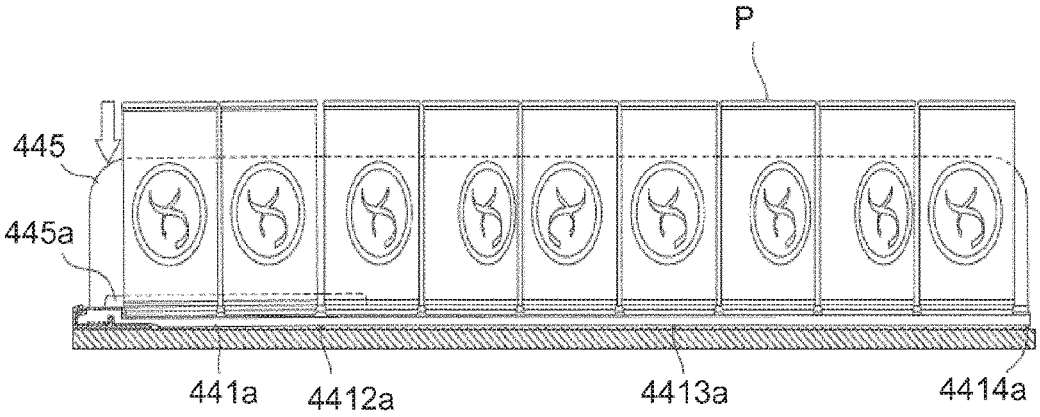
Figure 15:
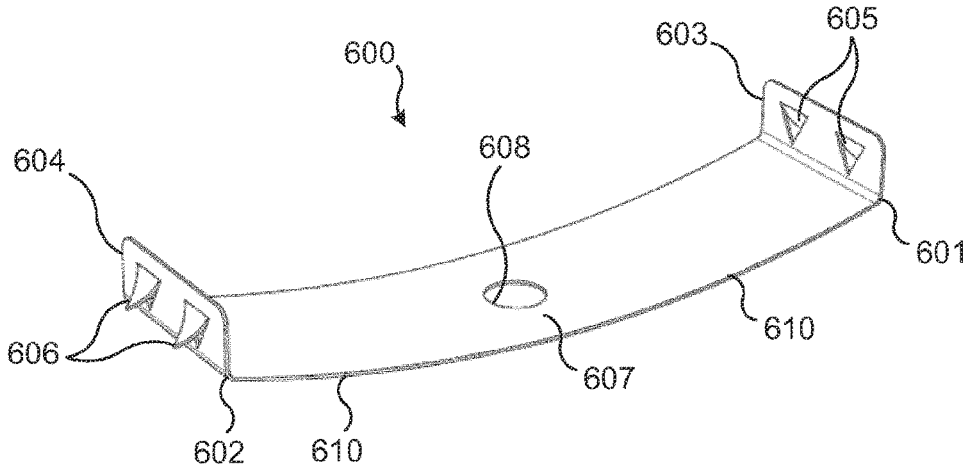
FIG. 15 is a perspective view of a resilient member which may be used at systems according to the invention.

FIGS. 14*a* and 14*b* illustrates the same system as shown in FIGS. 13*a* and 13*b* when a number of products P have been placed on the shelf accessory's bottom plate 441. FIG. 13*a* illustrates the engagement position, wherein the resilient member 458 urges the engagement flange 452 into engagement with the engagement wall 423. For allowing displacement of the accessory with products along the shelf a compressing force is again applied to the front of the accessory. However, in this situation, the gravity of the products being placed on the accessory's base member 441, behind the pivotal axis defined by the lower edge 1412*a* of the foremost second transverse wall 4412 will prevent rotation of the accessory about the pivotal axis. Instead the compressing force in combination with the gravity of the products P being placed in front of the pivotal axis will cause a the front portion 441*a* of the base member 441, which front portion extends from the foremost second transverse wall 4412 to the engagement member 450 to be deformed by bending. This situation is illustrated in FIG. 14*b*, where it is indicated that said front portion 441*a* of the base member 441 is bent such that it slopes slightly downwardly to the left in the figure. By this means, the engagement flange 452 may be brought out of engagement from the engagement wall 423, such that the accessory with products may be displaced to any position. Once the desired position has been reached, the compressive force is released and the spring force of the resilient member 458 in combination with the resiliency of the material forming the front portion 441*a* of the base member exceeds the gravity of the products being placed in front of the pivotal axis, such that the engagement flange 452 may again be urged into engagement with the engagement wall 423.

It should be noted at this fourth embodiment that the engagement flange 452 may always be urged into engagement with the engagement wall 423 for fixation of the accessory, also when comparatively heavy products have been placed on the base member of the shelf accessory.

In order to achieve a well functioning system according the fourth embodiment it has proven suitable to arrange the foremost second transverse wall 4412 and thereby the pivotal axis between 100 and 300 mm, preferably between 150 and 250 mm, from the front of the accessory and the engagement flange 452. The rearmost second transverse wall 4414 with projecting lower edge 4414*a* is arranged at the rearmost end of the accessory for avoiding that the accessory 440 is pivoted in the clock wise direction from the position shown in FIG. 13*a* when heavy products are positioned only at the rear end of the accessory. The middle or intermediate second transverse rear wall 4413 with projecting lower edge 4413*a* is positioned approximately midway between the foremost 4412 and the rearmost 4414 second transverse walls. This intermediate lower edge 4413*a* mainly serves the purpose of preventing a mid portion of base member 441, arranged between the foremost 4412*a* and rearmost 4414*a* lower edges to sag downwardly, when heavy products are placed along this portion.

Further more, in order to readily allow the front portion 441*a* to be resiliently bent as seen in FIG. 14*b*, an elongate through opening 445*a* is formed in the lower portion of the partition wall 445. The otherwise rigidifying effect of the vertical partition wall being fixed to the base member along its entire length is hereby eliminated.

In the above described fourth embodiment of the invention the accessory's resilient member may thus be said to comprise both the leaf spring and the resilient front portion 441*a* of the base member.

In a non-shown alternative of the fourth embodiment the downwardly projecting edges may be exchanged by the sidewalls of the base member being extended somewhat downwardly along a portion of the base member which corresponds to the distance between the foremost second transverse wall and the rearmost second transverse wall. The lower edges of these extended sidewall portions so define a horizontal support plane which rests on the shelf in normal use. When a compressing force is applied to the front of the shelf, for releasing the engagement flange from the engagement wall, the front edges of these extended portions will define a pivot axis, around which the accessory may pivot, in correspondence with what is described above.

FIGS. 15-17*b* illustrate an alternative and preferred embodiment of a resilient member to be used at a system according to the invention. The resilient member 600 is formed of a generally rectangular leaf spring of spring metal. At opposed ends 601, 602 of the rectangular leaf spring, it comprises folded fixation tabs 603, 604. Both fixation tabs 603, 604 are provided with outwardly projecting dents 605, 606. This resilient member 600 may be fixed to a engagement member of a shelf accessory by introducing the fixation tabs 603, 604 into a spring recess of the type shown at 159 in FIG. 3*a*. When the tabs 603, 604 have been inserted in the spring recess 159 the dents will engage the short walls of the spring recess and thereby prevent removal of the resilient member 600 from the engagement member.

The resilient member also exhibits a weakened portion 607 arranged in a mid portion between the opposed ends 601, 602. The mid portion 607 is separated from the end portions 601, 602 by a respective intermediate portion 610. At the illustrated example, the weakening of the mid portion 607 is achieved by means of a through hole 608 arranged in this portion.

FIGS. 16*a*-17*b* illustrates how the resilient member is mounted and functions at a shelf accessory in a system according to the invention. The resilient member 600 is fixed in a spring recess 659. The engagement member 650 exhibits a spring support surface 660 which is arranged in the recess 659 above the weakened mid portion 607 of the resilient member 600. As in the above described examples the resilient member is pretensioned such that the mid portion convexly bulges out of the recess 659 passed the spring support surface 660 and the entire lower surfaces of the engagement member 650.

Figure 16A:
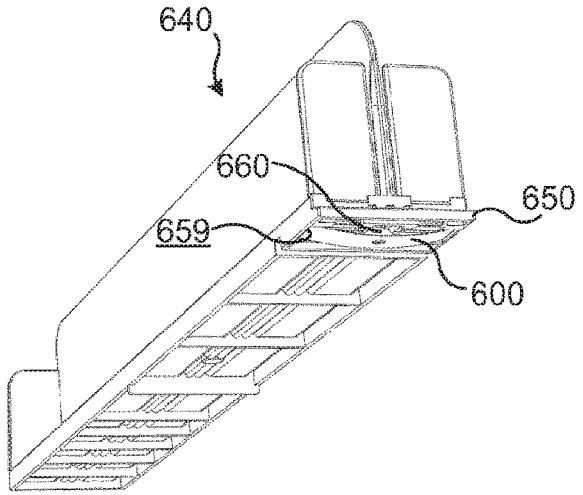
FIG. 16*a* is a perspective view of a shelf accessory provide with a resilient member shown in FIG. 15
Figure 16B:
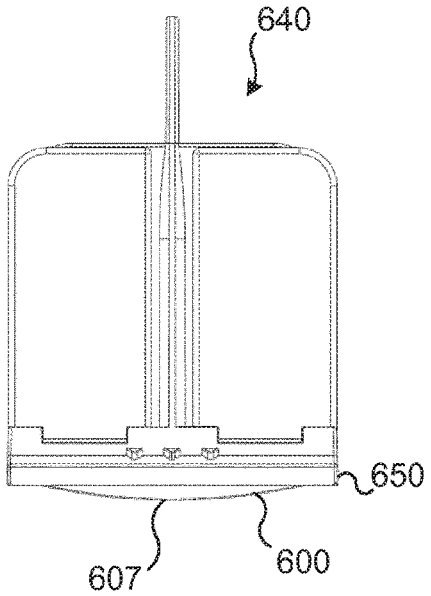
FIG. 16*b* is a front view thereof, both figures illustrating the resilient member in an unloaded condition.

FIGS. 16*a* and *b* illustrate the resilient spring in the pretensioned but unloaded state, where it convexly bulges out with a single curve. This unloaded state of the resilient member corresponds to the engagement position of the engagement device where the spring force urges the engagement member 650 into engagement with the engagement wall (not shown) of the front fixation device, as described above.

Figure 17A:
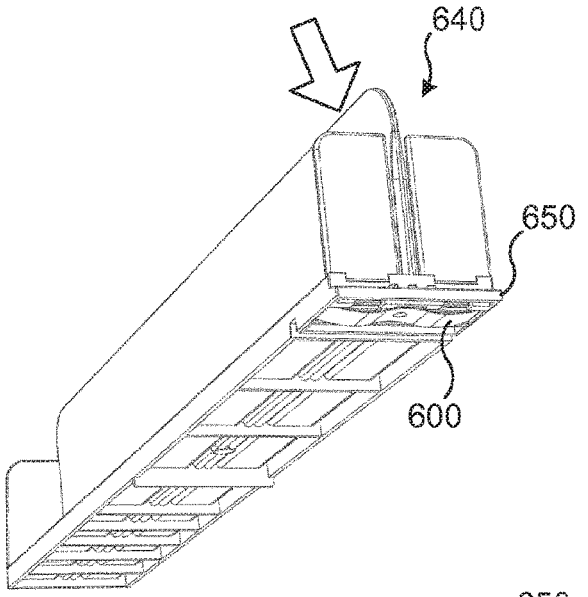
FIGS. 17*a* and 17*b* are views corresponding to FIGS. 16*a* and 16*b* showing the resilient member in a loaded compressed condition.
Figure 17B:
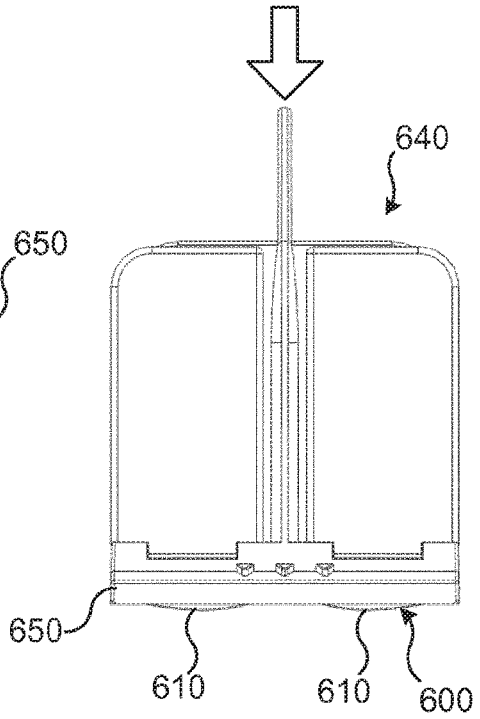

FIGS. 17*a*-*b* illustrate the resilient member when a downwardly directed force has been applied for bringing the engagement member 650 out of engagement with the engagement wall (not shown) of the front fixation device (not shown) as described above. However at this embodiment the downwardly directed force has caused the resilient member, being in contact with the bottom plate (not shown), to collapse to the state indicated in FIGS. 17*a*-*b*. As seen in the figures, the weakening of the mid portion 607 of the resilient member, which mid portion originally was in contact with the base plate, has caused this mid portion a snap-like deformation. More precisely, the mid portion 607 of the resilient member 600 has collapsed and moved towards the engagement member 650, until it has come into bearing contact with the spring support surface 660. At this supported position of the mid portion 607 the mid portion 607 is prevented from moving further upwards, i.e. away from the bottom plate. The so deformed resilient member thus exhibits tree portions, i.e. both end portions 601, 602 and the mid portion 607 which are supported by the engagement member 650. As seen in FIGS. 17*a* and 17*b*, the intermediate spring portions 610 arranged between these supported portions still convexly bulges out from the spring recess and passed the support surface as well as the lower surfaces of the engagement member. It should be noted that in the unloaded state shown in FIGS. 16*a* and 16*b* the mid portion 607 projects a first distance which is greater a second distance by which the intermediate portions 610 protrude in the loaded state. The difference between these distances is sufficient to allow the engagement member 650 to be brought out of engagement from the engagement wall of the front fixation device, thus allowing the shelf accessory to be displaced along the fixation device as described above. However the second distance is sufficient to maintain the lower portion of the engagement member 650 out of contact from the base plate of the front fixation device. By this means the friction between the shelf accessory and the front fixation device will, during displacement of the shelf accessory by caused mainly solely by the comparatively low friction between the resilient member and the base plate.

Grace to the mid portion 607 being supported by the support surface 660 and the comparatively short intermediate portions 610, the resilient member will maintain this collapsed double wave shape also when high compression forces are applied. By this means, the low friction contact between the engagement member and the front fixation device is maintained also when high compression forces have been applied for releasing the engagement between the engagement member and the engagement wall of the front fixation device. This embodiment thus provides for that the shelf accessories may readily be repositioned without the need for applying a precise compression force. The embodiment thus facilitates use of the system and provides a reliable construction.

Figure 7A:
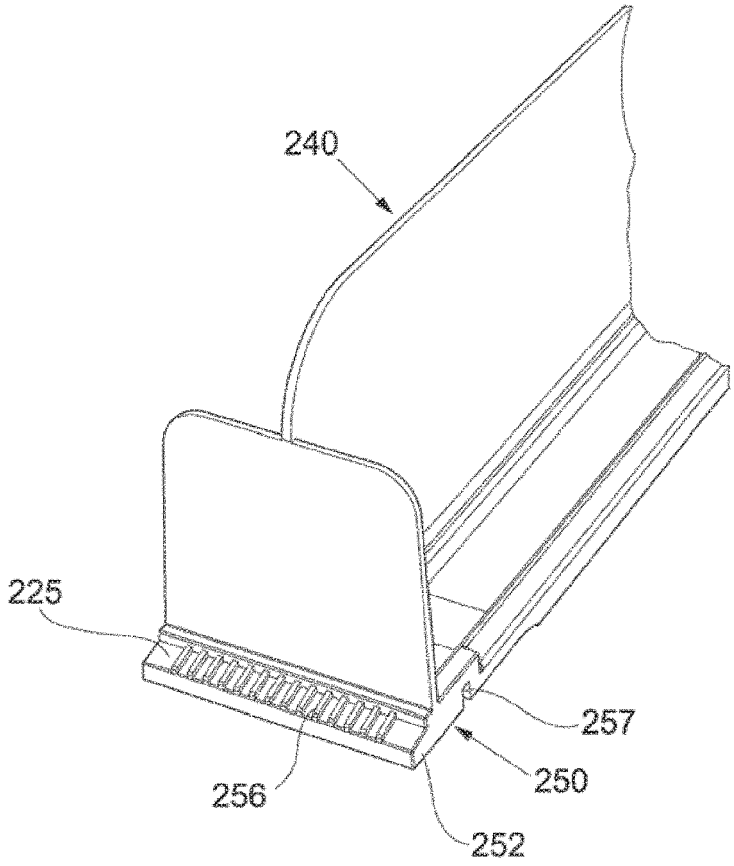
FIGS. 7*a* and 7*b* are perspective views of a shelf accessory forming part of the system according to the second embodiment.
Figure 7B:
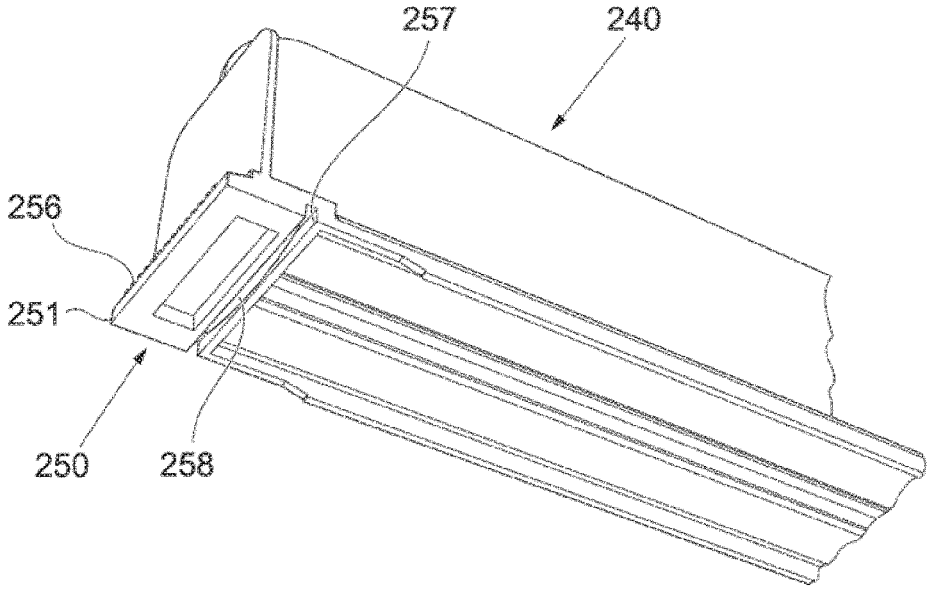
Figure 8A:
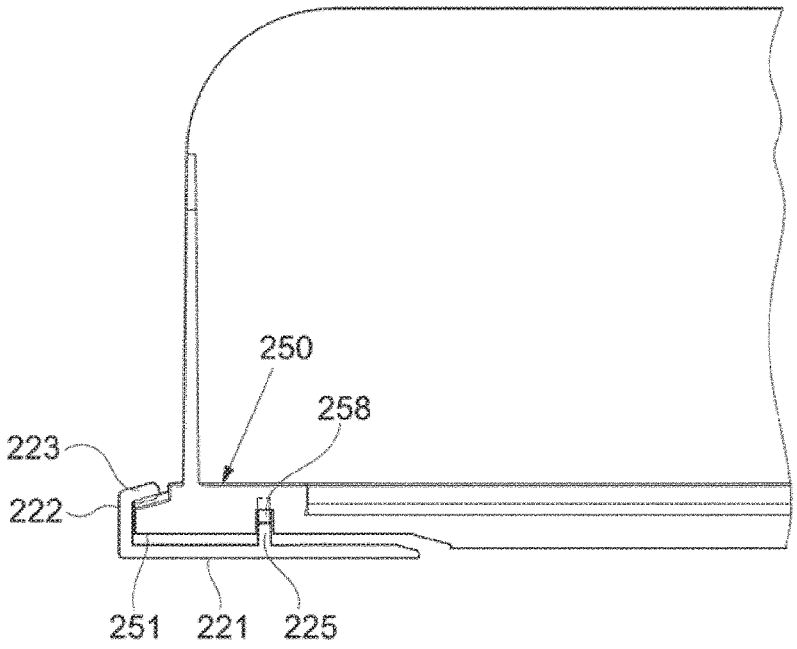
FIGS. 8*a* and 8*b* are side views illustrating the front fixation device shown in FIG. 6 and a front portion of an accessory shown in FIGS. 7*a* and 7*b* and illustrate the accessory in two different operational positions.
Figure 8B:
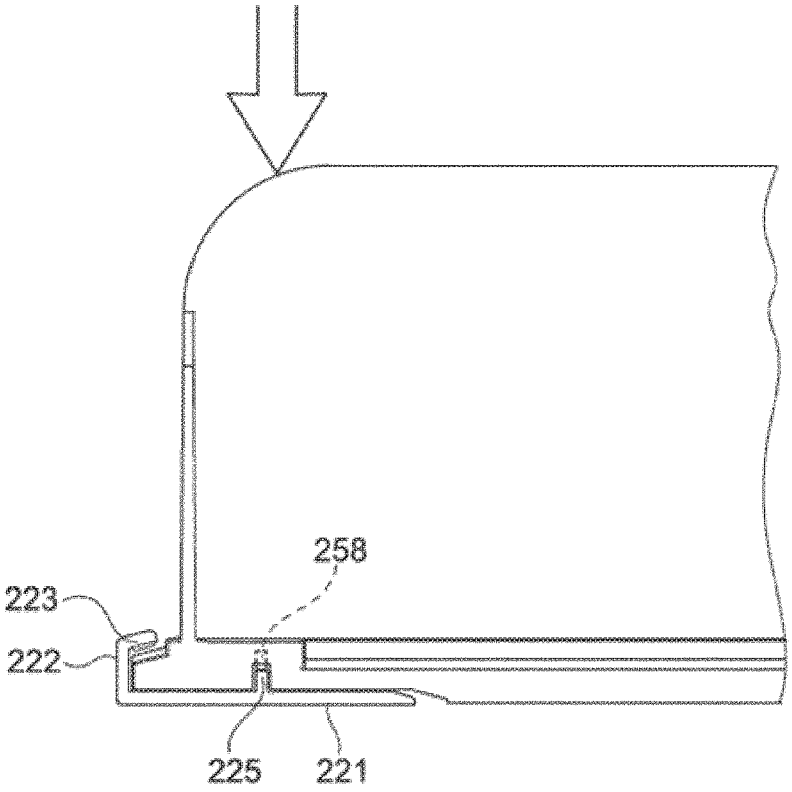
Figure 9:
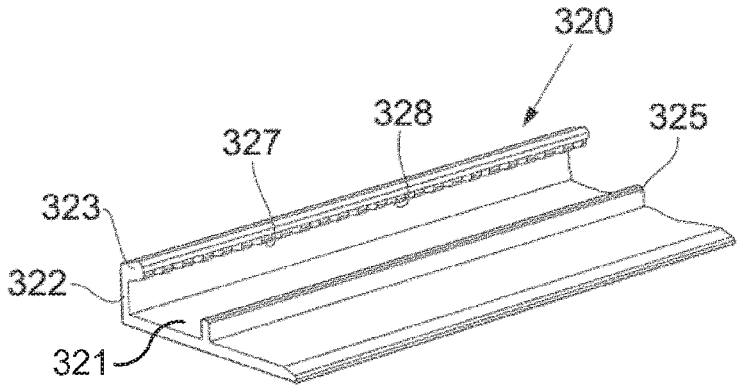
FIG. 9 is a perspective view of a portion of a front fixation device forming part of a system according to a third embodiment of the system.
Figure 10A:
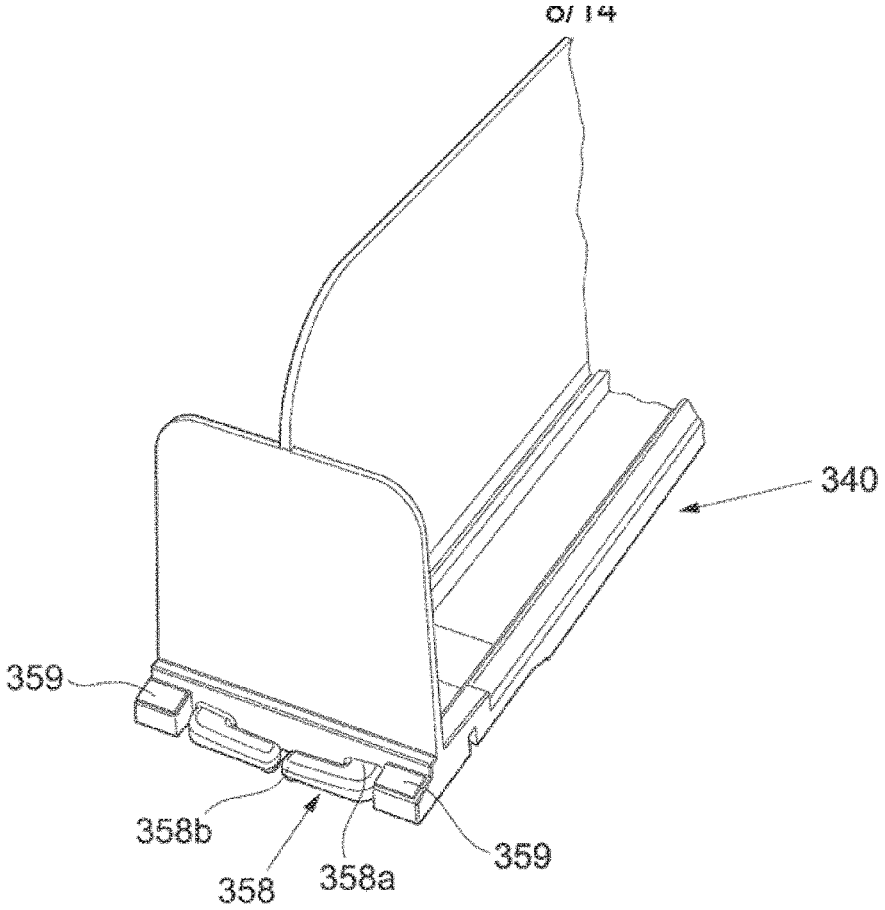
FIGS. 10*a* and 10*b* are perspective views of a front portion of an accessory forming part of the system according to the third embodiment.
Figure 10B:
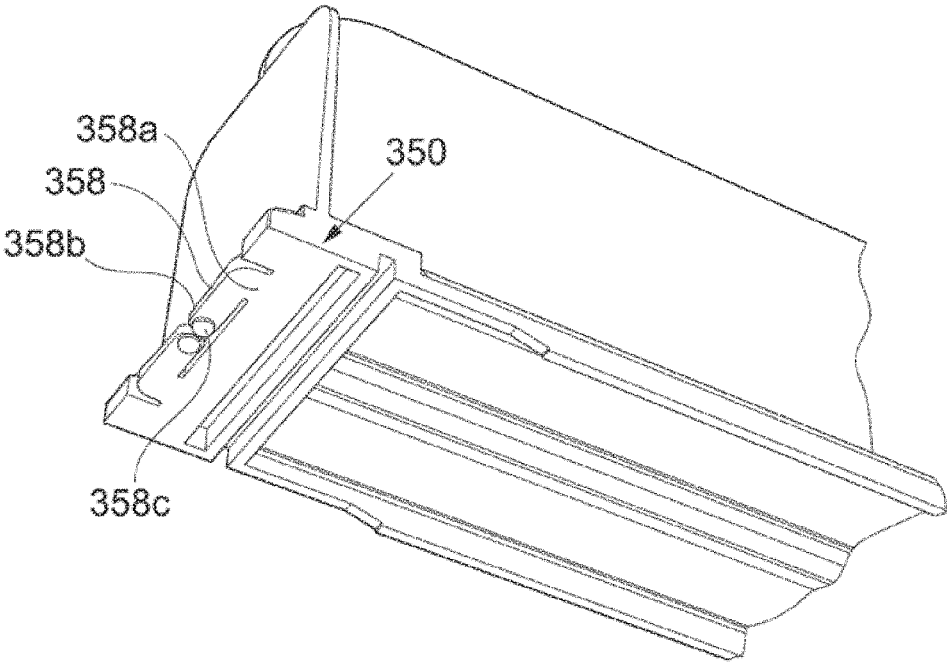
Figure 11A:
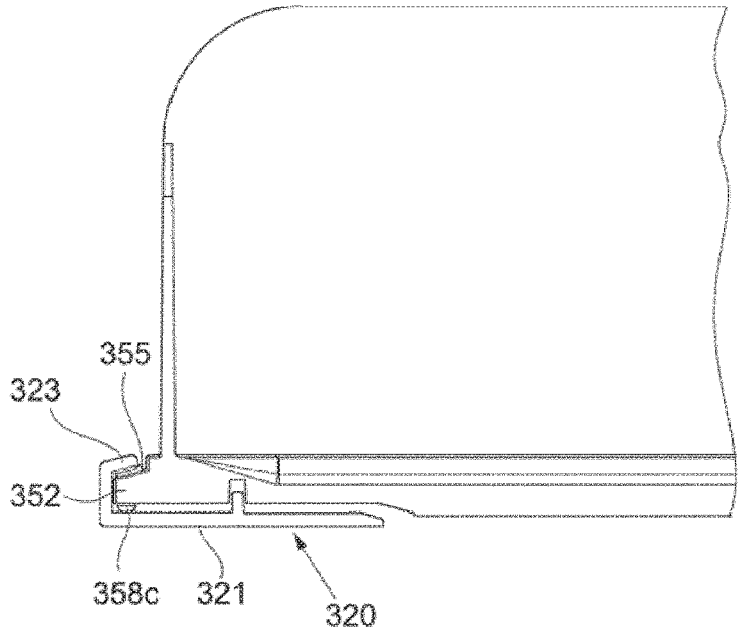
FIGS. 11*a* and 11*b* are side views illustrating the front fixation device shown in FIG. 9 and a front portion of the accessory shown in FIGS. 10*a* and 10*b* and illustrate the accessory in two different operational positions.
Figure 11B:
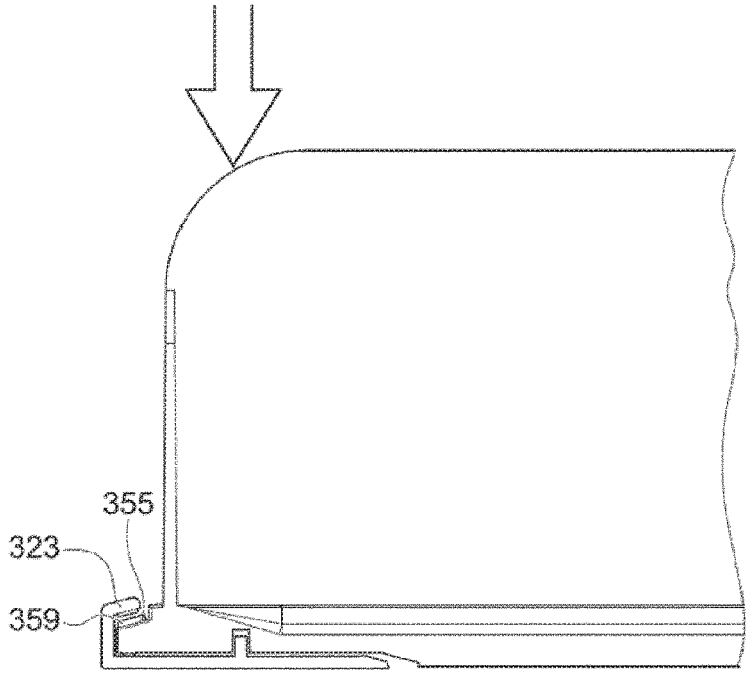

Although not shown in the figures the above described snap-collapsing configuration may be applied also the resilient member shown in FIGS. 3*a*, 7*b* and 12.

Above a number of exemplifying embodiments of the system according to the invention have been described. The invention is however not limited to theses embodiments. To the contrary, it may freely be varied within the scope of the appended claims. For example, instead of forming a shelf divider, the accessory may be of any desirable kind such as a tray, a pusher, a combined divider and pusher, a roller track and the like.

The different features of the embodiments shown and described above may further be combined between the embodiments. E.g. irrespective of the resilient member being formed as in the first, second or third embodiment the means for preventing longitudinal displacement in the engagement position may comprise any combination of teeth, recesses and friction increasing layers arranged at the engagement member and the front fixation device. The invention also encompasses that such means are dispensed with and that the engagement between the engagement member and the engagement wall of the front fixation is accomplished merely by flat contact between these members.

The invention claimed is:

1. System for fixation of shelf accessories to a shelf, the system comprising;

an elongate front fixation device (120, 220, 320, 420,) having a longitudinal direction and being arranged to be fixed to a shelf (10), at or adjacent and in parallel with a front edge (11) of said shelf, said front fixation device comprising at least one channel wall (123, 223, 323, 423) defining a longitudinally extending, open engagement channel (124, 224, 324, 424), and at least one shelf accessory (140, 240, 340, 440, 640) arranged to be supported on an upper surface of the shelf and comprising an engagement member (150, 250, 350, 450, 650) arranged to be brought into engagement with said channel wall, for fixation of the shelf accessory to the front fixation device and the shelf, wherein the shelf accessory comprises a resilient member (158, 258, 358, 458, 441*a*, 600) arranged to press the engagement member into an engaged position at which the engagement member is in engagement with the channel wall and to allow the engagement member to be brought to a disengaged position at which the engagement member is disengaged from the channel wall by deformation of the resilient member, the resilient member is arranged to contact the front fixation device both in the engaged position and in the disengaged position of the engagement member.

2. System according to claim 1, wherein the engagement member (150, 250, 350, 450, 650) comprises an engagement flange (152, 252, 352, 452, 552) arranged to be received in the engagement channel (124, 224, 324, 424,).

3. System according to claim 1, wherein the front fixation device (120, 220, 320, 420) comprises a longitudinally extending guide flange (125, 225, 325, 425) and the shelf accessory (140, 240, 340, 440, 640) exhibits a guide channel (157, 257, 357, 457) arranged to receive the guide flange.

4. System according to claim 3, wherein the guide flange (125, 225, 325, 425) and the guide channel (157, 257, 357, 457) are arranged such that the guide flange is received in the guide channel with a close fit.

5. System according to claim 3, wherein the length of the guide channel (157, 257, 357, 457) is greater than ⅛ of the length of the accessory (140, 240, 340, 440) in a direction perpendicular to the longitudinal direction of the guide channel.

6. System according to claim 1, wherein the resilient member (600) is arranged to assume a first predetermined shape when unloaded and a second predetermined collapsed shape when loaded by a force greater than a certain threshold force.

7. System according to claim 6, wherein the resilient member (600), when assuming the collapsed shape, is supported by the shelf accessory (640) such that loading the resilient member with a force greater than the threshold does not cause any further appreciable deformation of the resilient member.

8. System according to claim 1, wherein the resilient member (158, 258, 458, 600) comprises a separate part being fixed to the engagement member (150, 250, 450, 650).

9. System according to claim 8, wherein the resilient member (158, 258, 458, 600) comprises a leaf spring.

10. System according to claim 9, wherein the leaf spring (600) comprises a weakened portion (607).

11. System according to claim 10, wherein the leaf spring (600) is rectangular and the weakened portion (607) is arranged at a longitudinal mid portion of the leaf spring.

12. System according to claim 10, wherein the weakened portion (607) comprises a through hole (608) arranged in the leaf spring (600).

13. System according to claim 9, wherein the leaf spring (600) is fixed to the shelf accessory (640) at opposite end portions of the leaf spring and the shelf accessory comprises a support surface (660) arranged to support a portion (607) of the leaf spring when the leaf spring has been deformed from its unloaded shape by applying a compression force.

14. System according to claim 1, wherein the resilient member (358, 441*a*, 458,) comprises an integral part of the accessory (340, 440,).

15. System according to claim 14, wherein the resilient member (358) comprises a resilient arm having a free end (358*b*) which is arranged to bear against the front fixation device (320).

16. System according to claim 1, wherein the resilient member (158, 358, 458, 600) is arranged at or in proximity to the engagement flange (150, 350, 450).

17. System according to claim 3, wherein the resilient member (258) is positioned in the guide channel (257) and arranged to bear against the guide flange (225).

18. System according to claim 1, wherein the accessory (440) is provided with a downwardly projecting pivot member which is arranged to be supported by the upper surface of the shelf and which defines a pivotal axis being parallel to the longitudinal direction of the front fixation device (420), for allowing at least a front portion of the accessory to pivot about the pivotal axis when the engagement member (450) is brought out of engagement from the channel wall (423).

19. System according to claim 18, wherein the pivotal member comprises a downwardly projecting rib (4412*a*) which extends perpendicular to the longitudinal direction of the accessory (440).

20. System according to claim 18, wherein the pivotal axis is arranged between 100 and 300 mm from a front edge of the accessory (440).

21. System according to claim 1, wherein the engagement member (150, 250, 350, 650) and the channel wall (123, 223, 323) are provided with co-operating engagement means (127, 128, 156, 229, 256, 327, 328, 359) arranged to prevent displacement of the shelf accessory (140, 240, 340) in the longitudinal direction of the front fixation (120, 220, 320) device when the engagement member is in engagement with the engagement wall.

22. System according to claim 21, wherein the engagement means comprises teeth (127, 156, 256, 327) and/or a friction increasing elastic layer (229, 359) being provided on the engagement member (150, 250, 350) and the channel wall 123, 223, 323).

23. System according to claim 21, wherein the engagement means comprises interacting teeth (127, 156) provided on both of the engagement member (150) and the channel wall (123).

24. System according to claim 21, wherein the engagement means comprises teeth (256, 327) arranged on one of the engagement member (250, 350) and the engagement wall (223, 323), and a friction increasing elastic layer (229, 359) arranged on the other of the engagement member (250, 350) and the channel wall (223, 323).

25. System according to claim 1, wherein the front fixation device (120, 220, 320, 420) and the engagement member (150, 250, 350, 450, 650) constitute the only means for fixing the shelf accessory (140, 240, 340, 440, 640) to a shelf (10).

26. System according to claim 1, wherein the resilient member (158, 258, 358, 458, 600) comprises a low friction material arranged to be in contact with the front fixation device.

27. System according to claim 26 wherein the low friction material is metal forming the resilient member (158, 258 458, 600).

28. Shelf accessory (140, 240, 340, 440, 640) for use with a system according to claim 1, which shelf accessory is arranged to be supported on an upper surface of the shelf and comprises an engagement member (150, 250, 350, 450, 650) arranged to be brought into engagement with a channel wall (123, 223, 323, 423) of a front fixation device (120, 220, 320, 420), for fixation of the shelf accessory to the front fixation device and the shelf, wherein the shelf accessory comprises a resilient member (158, 258, 358, 458, 441*a*, 600) arranged to press the engagement member into an engaged position at which the engagement member is in engagement with the channel wall and to allow the engagement member to be brought to a disengagement position at which of the engagement member is disengaged from the channel wall by deformation of the resilient member, the resilient member is arranged to contact the front fixation device both in the engaged position and in the disengaged position of the engagement member.

* * * * *